US009553382B2

(12) United States Patent
Sun et al.

(10) Patent No.: US 9,553,382 B2
(45) Date of Patent: Jan. 24, 2017

(54) HEADPHONE SOCKET ASSEMBLY AND ELECTRONIC EQUIPMENT INCLUDING SAME

(71) Applicant: Xiaomi Inc., Beijing (CN)

(72) Inventors: Wei Sun, Beijing (CN); Feng Guo, Beijing (CN); Zhenfei Lei, Beijing (CN)

(73) Assignee: Xiaomi Inc., Beijing (CN)

( * ) Notice: Subject to any disclaimer, the term of this patent is extended or adjusted under 35 U.S.C. 154(b) by 0 days.

(21) Appl. No.: 14/585,297

(22) Filed: Dec. 30, 2014

(65) Prior Publication Data

US 2015/0380847 A1 Dec. 31, 2015

Related U.S. Application Data

(63) Continuation of application No. PCT/CN2014/089299, filed on Oct. 23, 2014.

(30) Foreign Application Priority Data

Jun. 27, 2014 (CN) ..... 2014 1 0302988

(51) Int. Cl.

| | |
|---|---|
| ***H01R 12/77*** | (2011.01) |
| ***H01R 24/58*** | (2011.01) |
| ***H01R 12/72*** | (2011.01) |
| ***H01R 13/6594*** | (2011.01) |

(52) U.S. Cl.

CPC ..... *H01R 12/775* (2013.01); *H01R 12/722* (2013.01); *H01R 13/6594* (2013.01); *H01R 24/58* (2013.01)

(58) Field of Classification Search

CPC ..... H01R 13/6658; H01R 13/65802; H01R 23/025; H01R 23/6873

See application file for complete search history.

(56) References Cited

U.S. PATENT DOCUMENTS

| | | | | |
|---|---|---|---|---|
| 6,504,727 | B1 * | 1/2003 | Kitamura | H04M 1/0274 174/377 |
| 6,831,843 | B2 | 12/2004 | Kitamura et al. | |
| 8,149,594 | B2 * | 4/2012 | Nishihata | H05K 9/002 174/250 |
| 8,905,791 | B2 * | 12/2014 | Zito | H01R 12/70 439/638 |
| 2002/0019154 | A1 * | 2/2002 | Na | H05K 1/147 439/76.1 |

(Continued)

FOREIGN PATENT DOCUMENTS

| | | |
|---|---|---|
| CN | 1183019 A | 5/1998 |
| CN | 1303225 A | 7/2001 |

(Continued)

OTHER PUBLICATIONS

International Search Report of PCT/CN2014/089299, from the State Intellectual Property Office of China, mailed Mar. 18, 2015.

(Continued)

*Primary Examiner* — Gary Paumen

(74) *Attorney, Agent, or Firm* — Finnegan, Henderson, Farabow, Garrett & Dunner LLP

(57) ABSTRACT

A headphone socket assembly for use in electronic equipment, includes: a headphone socket electrically connected to a circuit board in the electronic equipment; and an electromagnetic shielding device disposed at a periphery of the headphone socket.

8 Claims, 11 Drawing Sheets

(56) References Cited

U.S. PATENT DOCUMENTS

| | | | | |
|---|---|---|---|---|
| 2003/0039109 | A1 | 2/2003 | Kitamura et al. | |
| 2005/0118868 | A1* | 6/2005 | Nagashima | H05K 9/006 439/76.1 |
| 2006/0240689 | A1* | 10/2006 | Inoue | H05K 1/0243 439/76.1 |
| 2007/0178771 | A1 | 8/2007 | Goetz et al. | |
| 2010/0155489 | A1 | 6/2010 | Chang | |
| 2011/0116747 | A1 | 5/2011 | Terlizzi et al. | |
| 2011/0319132 | A1 | 12/2011 | Hsu | |
| 2014/0051291 | A1 | 2/2014 | Safir et al. | |
| 2014/0051727 | A1* | 2/2014 | Glick | C07D 213/75 514/335 |

FOREIGN PATENT DOCUMENTS

| | | | |
|---|---|---|---|
| CN | 2938463 | Y | 8/2007 |
| CN | 200987019 | Y | 12/2007 |
| CN | 202026449 | U | 11/2011 |
| CN | 202523874 | U | 11/2012 |
| CN | 202523886 | U | 11/2012 |
| CN | 103096214 | A | 5/2013 |
| CN | 103108533 | A | 5/2013 |
| CN | 103311756 | A | 9/2013 |
| EP | 2498202 | A2 | 9/2012 |
| EP | 2590273 | A2 | 5/2013 |
| JP | 11-025203 | A | 1/1999 |
| JP | 2001-128278 | A | 5/2001 |
| JP | 2003-163434 | A | 6/2003 |
| JP | 2006-094147 | A | 4/2006 |
| JP | 2009-296485 | A | 12/2009 |
| JP | 2014-107635 | A | 6/2014 |
| KR | 20010067357 | A | 7/2001 |
| KR | 20030010178 | A | 2/2003 |
| KR | 20100063468 | A | 6/2010 |
| WO | WO 2011/150403 | A1 | 12/2011 |

OTHER PUBLICATIONS

European Search Report issued by the European Patent Office, issued on Nov. 11, 2015, in application EP 15173842.4.

Russian Office Action of Application No. 2014152993, from Russian Federal Institute of Industrial Property, dated Apr. 22, 2016.

English version of International Search Report of PCT/CN2014/089299, from the State Intellectual Property Office of China, dated Mar. 18, 2015.

* cited by examiner

HEADPHONE SOCKET ASSEMBLY AND ELECTRONIC EQUIPMENT INCLUDING SAME

CROSS REFERENCE TO RELATED APPLICATIONS

This application is a continuation of International Application No. PCT/CN2014/089299, filed Oct. 23, 2014, which is based upon and claims priority to Chinese Patent Application No. 201410302988.7, filed Jun. 27, 2014, the entire contents of all of which are incorporated herein by reference.

TECHNICAL FIELD

The present disclosure generally relates to the field of electronic equipment technology and, more particularly, to a headphone socket assembly and electronic equipment including the headphone socket assembly.

BACKGROUND

In a mobile terminal, a headphone socket can be susceptible to electromagnetic interference from an antenna because a distance therebetween can be short. In order to reduce the electromagnetic interference to the headphone socket from the antenna, conventionally, a filter circuit can be included in the mobile terminal to filter out the electromagnetic interference, thereby reducing the electromagnetic interference to the headphone socket from the antenna.

SUMMARY

According to a first aspect of the present disclosure, there is provided a headphone socket assembly for use in electronic equipment, comprising: a headphone socket electrically connected to a circuit board in the electronic equipment; and an electromagnetic shielding device disposed at a periphery of the headphone socket.

According to a second aspect of the present disclosure, there is provided electronic equipment, comprising: a headphone socket assembly; and a circuit board; wherein the headphone socket assembly includes: a headphone socket electrically connected to the circuit board in the electronic equipment; and an electromagnetic shielding device disposed at a periphery of the headphone socket.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
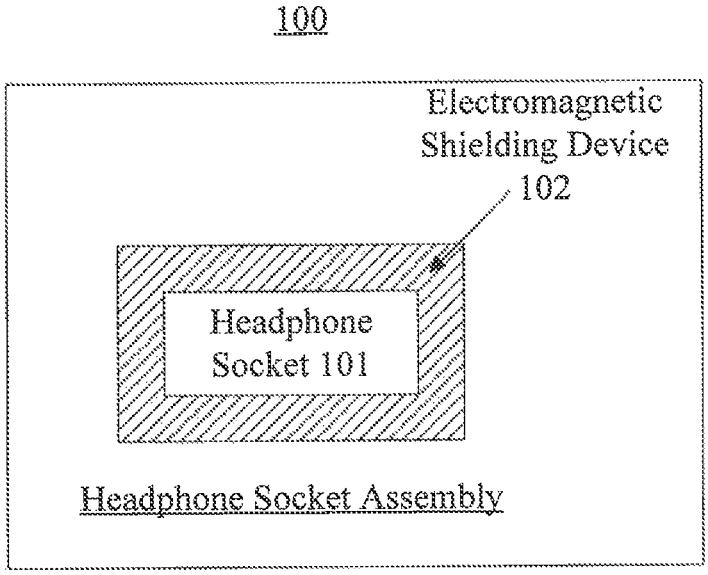
FIG. 1 is a block diagram of a headphone socket assembly, according to an exemplary embodiment.

FIG. 1 is a block diagram of a headphone socket assembly 100 for use in electronic equipment, according to an exemplary embodiment. Referring to FIG. 1, the headphone socket assembly 100 includes a headphone socket 101 and an electromagnetic shielding device 102.

In exemplary embodiments, the headphone socket 101 is electrically connected to a circuit board in the electronic equipment. For example, for the electronic equipment to externally connect a wired headphone, the electronic equipment includes the headphone socket 101 corresponding to the wired headphone. In addition, to enable the electronic equipment to control the headphone socket 101 so as to control the wired headphone, the headphone socket 101 is electrically connected to the circuit board in the electronic equipment.

In exemplary embodiments, the electronic equipment may be a mobile phone, a tablet computer, an electronic reader, a Moving Picture Experts Group Audio Layer III (MP3) player, a Moving Picture Experts Group Audio Layer IV (MP4) player, a laptop, etc.

In exemplary embodiments, the electromagnetic shielding device 102 is disposed at a periphery of the headphone socket 101. For example, to shield the headphone socket 101 from electromagnetic radiation generated by other electric devices on the circuit board, thus reducing electromagnetic interference to the headphone socket 101, the electromagnetic shielding device 102 is disposed at the periphery of the headphone socket 101.

The headphone socket assembly 100 can reduce the electromagnetic interference from other electric devices on the circuit board, thus preventing the headphone socket 101 from being affected by the electromagnetic interference.

In exemplary embodiments, one or more pins of the headphone socket 101 may be electrically connected to one or more conductive tracks on the circuit board through one or more welding points, respectively, or through a connector in the headphone socket assembly 100, which will be described below.

Figure 2A:
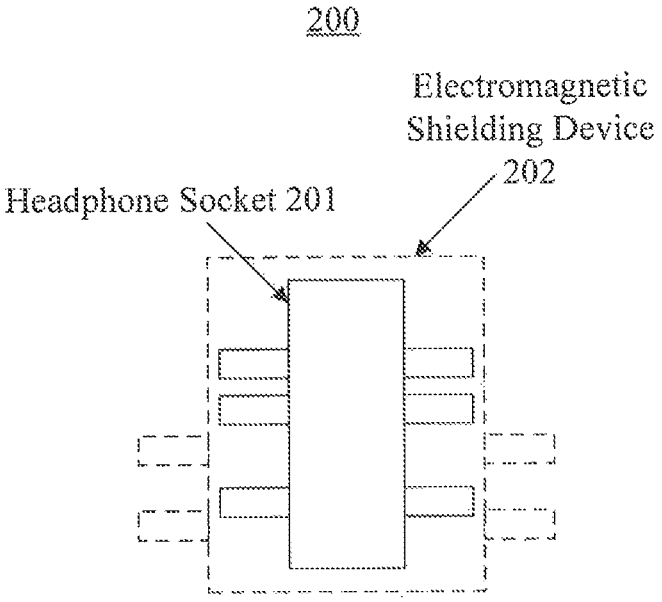
FIG. 2A is a block diagram of a headphone socket assembly, according to an exemplary embodiment.

FIG. 2A is a block diagram of a headphone socket assembly 200 for use in electronic equipment, according to an exemplary embodiment. Referring to FIG. 2A, the headphone socket assembly 200 includes a headphone socket 201 and an electromagnetic shielding device 202. In the illustrated embodiment, the headphone socket 201 is electrically connected to one or more conductive tracks on the circuit board through one or more welding points, respectively.

Figure 2B:
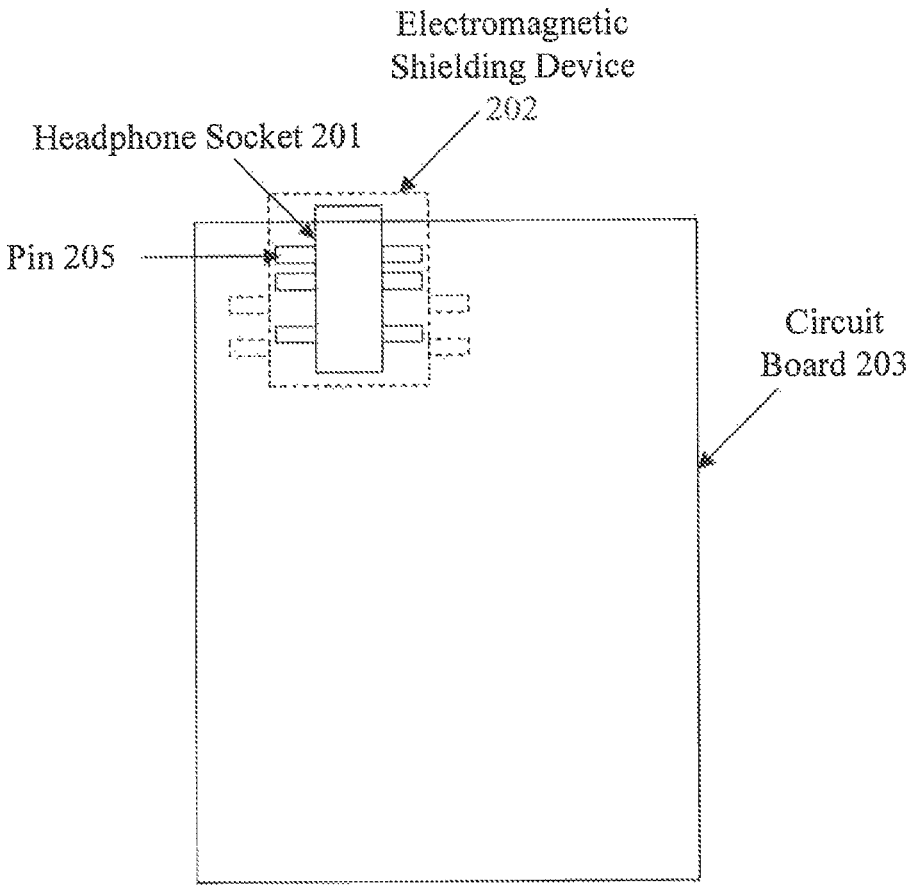
FIG. 2B is a block diagram of a headphone socket assembly connected to a circuit board, according to an exemplary embodiment.

FIG. 2B is a block diagram of the headphone socket assembly 200 (FIG. 2A) connected to a circuit board in the electronic equipment, according to an exemplary embodiment. Referring to FIG. 2B, the headphone socket 201 is electrically connected to a circuit board 203 in the electronic equipment. For example, for the electronic equipment to externally connect a wired headphone, the electronic equipment includes the headphone socket 201 corresponding to the wired headphone. In addition, to enable the electronic equipment to control the headphone socket 201 so as to control the wired headphone, the headphone socket 201 is electrically connected to the circuit board 203 in the electronic equipment. The electronic equipment may be a mobile phone, a tablet computer, an electronic reader, an MP3 player, an MP4 player, a laptop, etc. The circuit board 203 may include a plurality of electric devices, such as an antenna, a power amplifier, a resistor, a capacitor, a loudspeaker, and so on.

In the present embodiment, the headphone socket 201 is directly welded onto the circuit board 203, that is, one or more pins 205 of the headphone socket 201 are electrically connected to one or more conductive tracks on the circuit board 203 through one or inure welding points corresponding to the one or more pins 205, respectively.

Moreover, depending on a position on the electric equipment for connecting the wired headphone, the headphone socket 201 may be welded on any side of the circuit board 203. For example, the headphone socket 201 is welded on a top side of the circuit board 203 in FIG. 2B.

In exemplary embodiments, to reduce an electromagnetic interference to the headphone socket 201 from other electric devices on the circuit board 203, the headphone socket 201 can be welded at a position far away from each of the other electric devices. For example, an antenna usually generates a relatively large electromagnetic radiation, and causes a large electromagnetic interference to the headphone socket 201. Therefore, the headphone socket 201 can be welded at a position far away from the antenna on the circuit board 203.

Figure 2C:
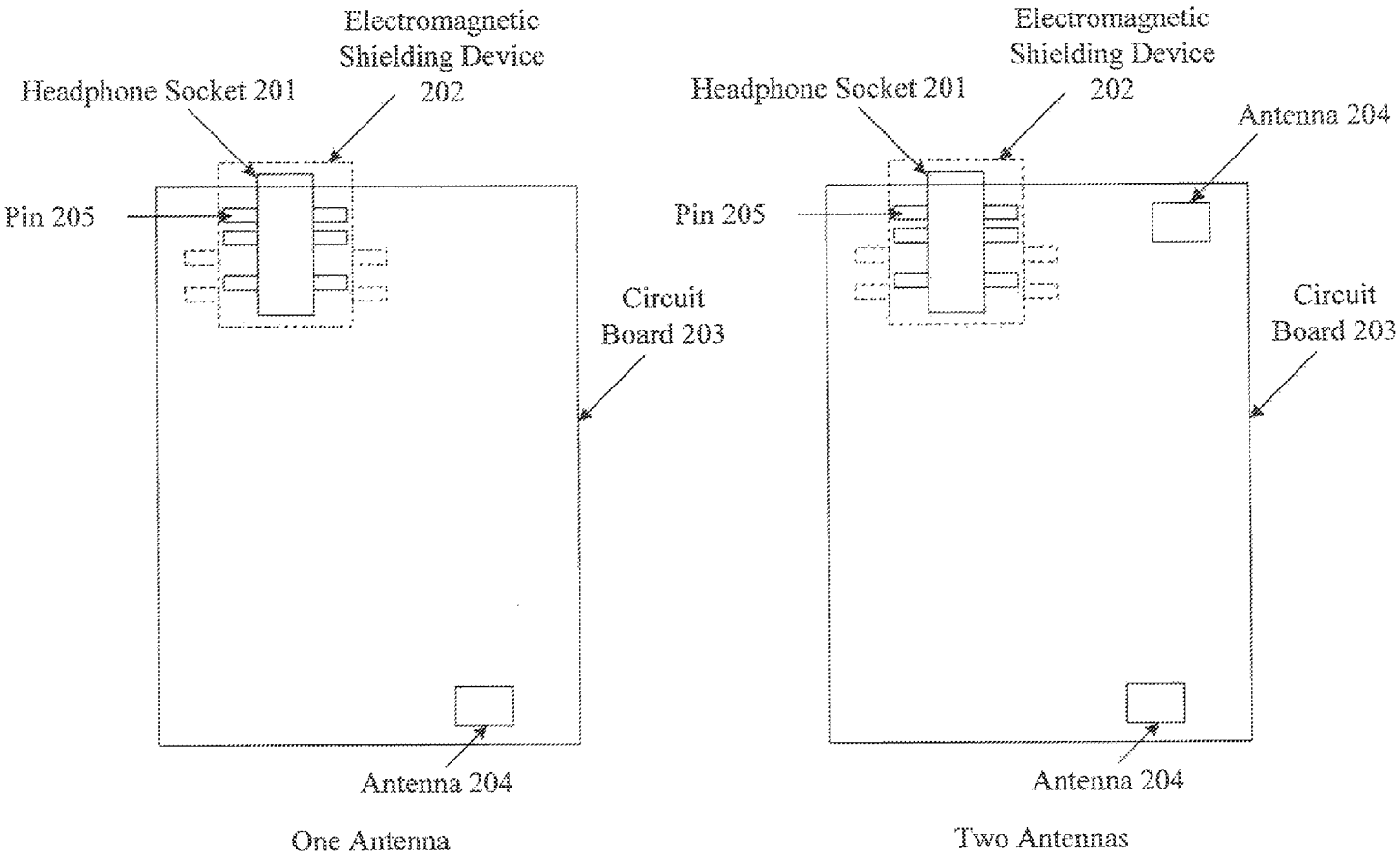
FIGS. 2C and 2D are block diagrams of a headphone socket assembly connected to a circuit board through welding points, according to exemplary embodiments.

FIG. 2C is a block diagrams of the headphone socket assembly 200 connected to the circuit board 203 (FIG. 2B) through welding points, according to an exemplary embodiment. Referring to FIG. 2C, the circuit board 203 may be connected to one antenna 204 (left figure in FIG. 2C) or two antennas 204 (right figure in FIG. 2C). Exemplary positions for welding the headphone socket 201 onto the circuit board 203 are shown FIG. 2C.

In exemplary embodiments, the electromagnetic shielding device 202 is disposed at a periphery of the headphone socket 201. In one exemplary embodiment, the electromagnetic shielding device 202 is an electromagnetic shielding cover. To shield the electromagnetic radiation generated by electric devices on the circuit board 203, thus reducing the electromagnetic interference to the headphone socket 201, the electromagnetic shielding cover covers the headphone socket 201 and also one or more welding points corresponding to the one or more pins 205 of the headphone socket 201, respectively, on the circuit board 203. The electromagnetic shielding cover can be grounded through the circuit board 203.

In exemplary embodiments, to reduce a size of the electromagnetic shielding cover, thus reducing an area occupied by the electromagnetic shielding cover welded on the circuit board 203 and reducing the cost for manufacturing the electromagnetic shielding cover, the electromagnetic shielding cover only needs to cover the headphone socket 201 and the one or more welding points corresponding to the one or more pins 205 of the headphone socket 201 on the circuit board 203, without the need of a larger size for the electromagnetic shielding cover.

Figure 2D:
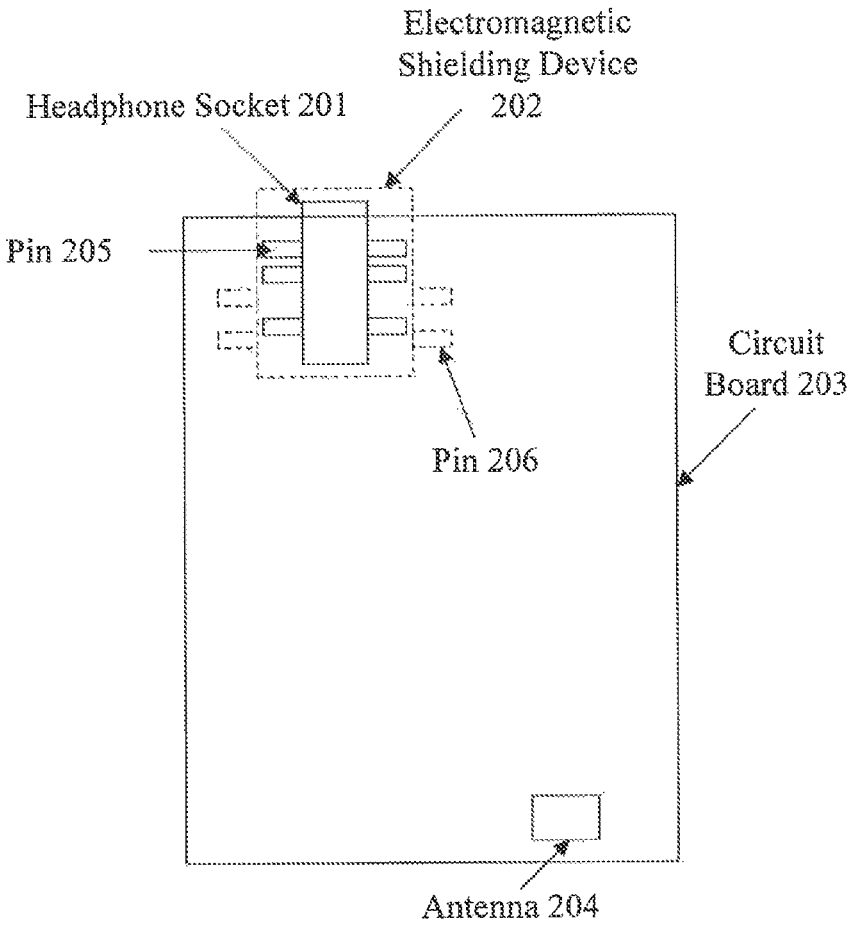

FIG. 2D is a block diagram of the headphone socket assembly 200 connected to the circuit board 203 (FIG. 2B) through welding points, according to exemplary embodiments. Referring to FIG. 2D, in exemplary embodiments, the electromagnetic shielding cover may be grounded via a plurality of pins, such as four pins 206, welded on the circuit board 203.

In exemplary embodiments, the electromagnetic shielding cover is disposed at the periphery of the headphone socket 201, such that the electromagnetic radiation generated by electric devices on the circuit board 203 can be shielded by the electromagnetic shielding cover, and the headphone socket 201 in the electromagnetic shielding cover can be prevented from being affected by the electromagnetic interference.

In exemplary embodiments, the electromagnetic shielding cover is disposed at the periphery of the headphone socket 201, and is capable of shielding the electromagnetic radiation generated by other electric devices on the circuit board 203. Therefore, the headphone socket 201 may be welded at any position on the circuit board 203 without considering a distance between the headphone socket 201 and other electric devices, such as the antenna 204.

Figure 3A:
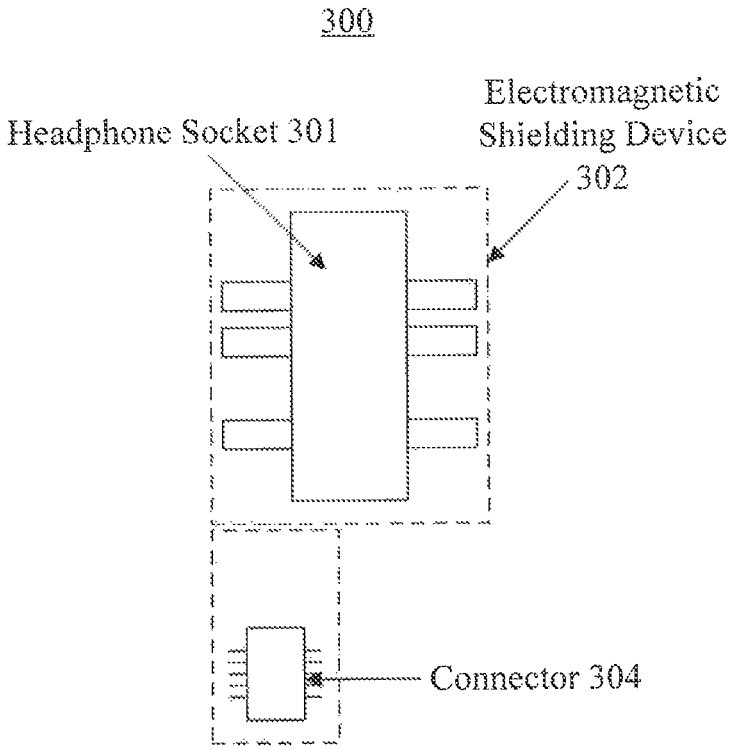
FIG. 3A is a block diagram of a headphone socket assembly, according to an exemplary embodiment.

FIG. 3A is a block diagram of a headphone socket assembly 300 for use in electronic equipment, according to an exemplary embodiment. Referring to FIG. 3A, the headphone socket assembly 300 includes a headphone socket 301 and an electromagnetic shielding device 302. In the illustrated embodiment, the headphone socket 301 is electrically connected to one or more conductive tracks on a circuit board in the electronic equipment through a connector 304.

Figure 3B:
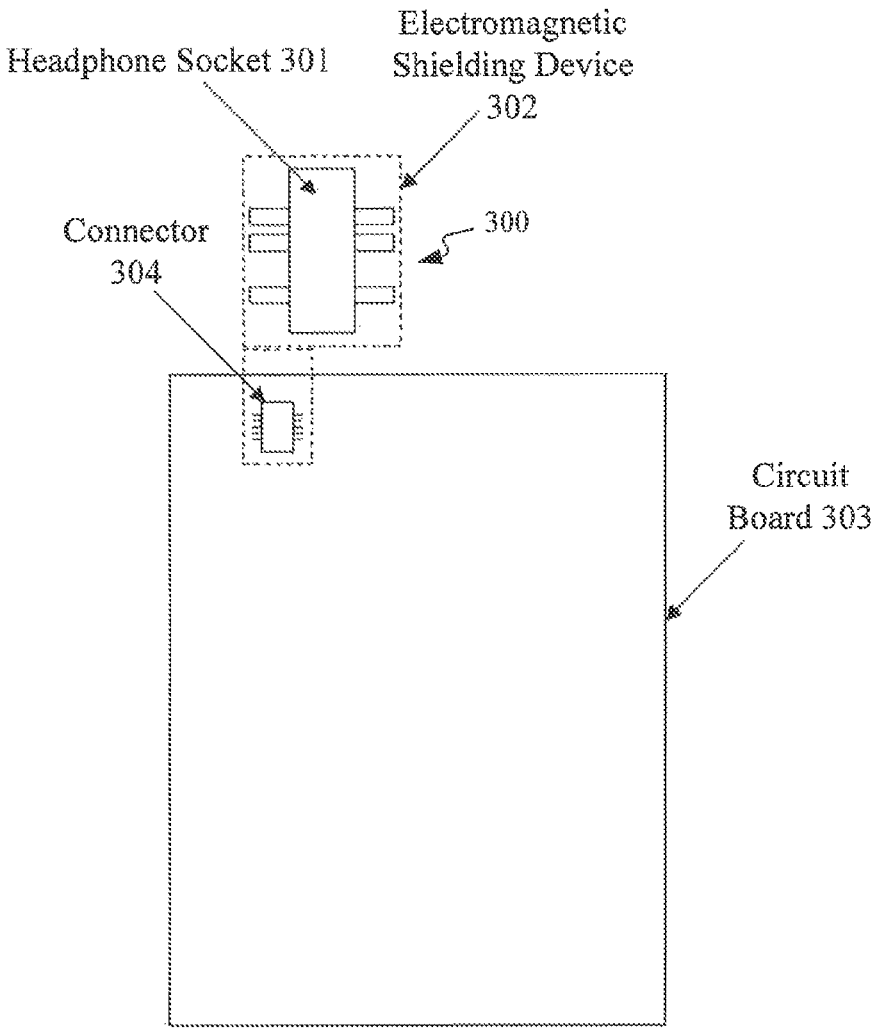
FIG. 3B is a block diagram of a headphone socket assembly connected to a circuit board, according to an exemplary embodiment.

FIG. 3B is a block diagram of the headphone socket assembly 300 (FIG. 3A) connected to a circuit board, according to an exemplary embodiment. Referring to FIG. 3B, the headphone socket 301 is electrically connected to a circuit board 303 in the electronic equipment. For example, for the electronic equipment to externally connect a wired headphone, the electronic equipment includes the headphone socket 301 corresponding to the wired headphone. In addition, to enable the electronic equipment to control the headphone socket 301 so as to control the wired headphone, the headphone socket 301 may be electrically connected to the circuit board 303 in the electronic equipment. The electronic equipment may be a mobile phone, a tablet computer, an electronic reader, an MP3 player, an MP4 player, a laptop, etc. The circuit board 303 may be connected to a plurality of electric devices, such as an antenna, a power amplifier, a resistor, a capacitor, a loudspeaker, and so on.

Figure 3C:
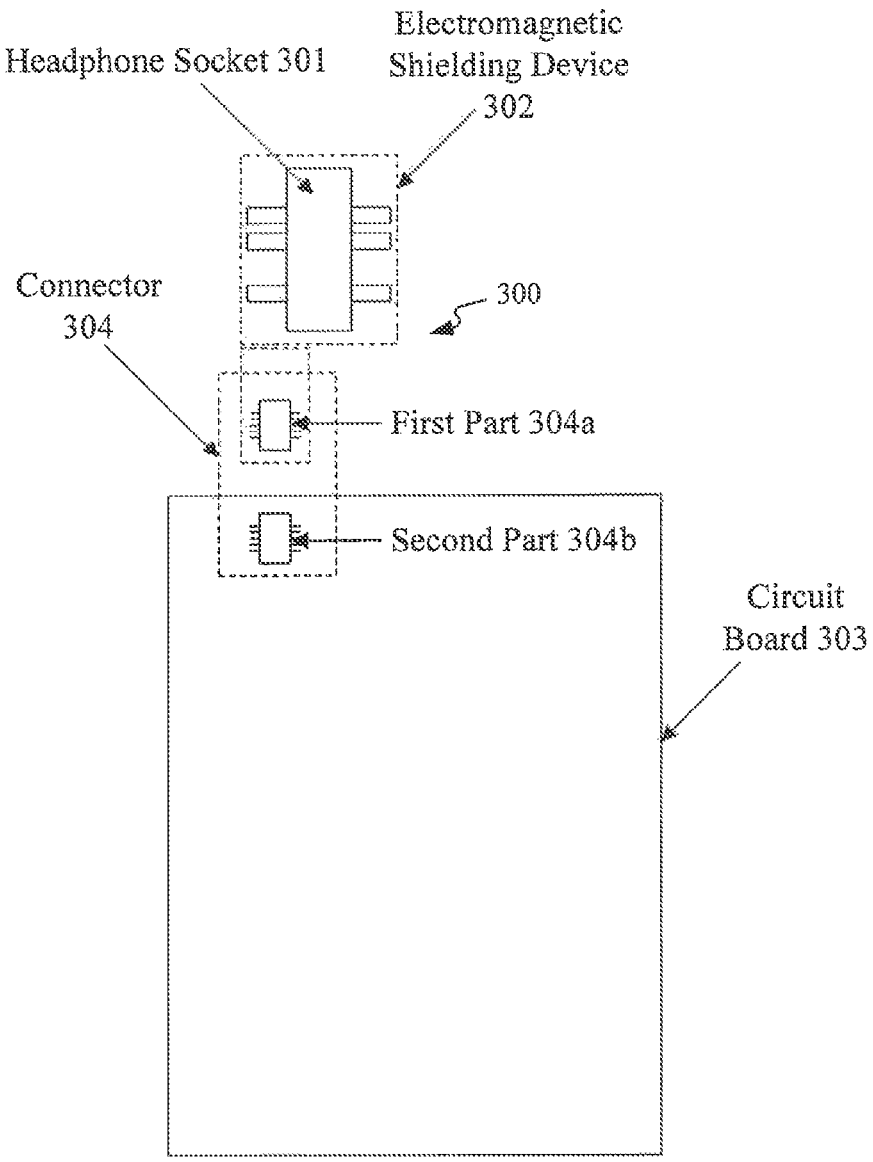
FIG. 3C is a block diagram of a headphone socket assembly connected to a circuit board through a connector, according to an exemplary embodiment.

In exemplary embodiments, the headphone socket assembly 300 includes the connecter 304 through which one or more pins of the headphone socket 301 are electrically connected to one or more conductive tracks on the circuit board 303, respectively. Referring to FIG. 3C, the connector 304 may include a first part **304*a* and a second part 304*b*** matching each other. Each pin of the first part 304*a* is correspondingly connected to a pin of the headphone socket 301, and each pin of the second part 304*b* is welded to a corresponding conductive track on the circuit board 303. After the first part 304*a* and the second part 304*b* of the connector 304 are connected, the pins of the headphone socket 301 are electrically connected to the respective conductive tracks on the circuit board 303 through the connector 304.

In exemplary embodiments, the electromagnetic shielding device 302 is disposed at a periphery of the headphone socket 301. In the present embodiment, the electromagnetic shielding device 302 is an electromagnetic shielding layer. To shield the electromagnetic radiation generated by electric devices on the circuit board 303, thus reducing the electromagnetic interference to the headphone socket 301, the electromagnetic shielding layer covers the periphery of the headphone socket 301.

In exemplary embodiments, the electromagnetic shielding layer may be a flexible printed circuit board (FPC) coated with electromagnetic shielding material. The headphone socket 301 may be welded on the FPC and then covered by the FPC, such that the headphone socket 301 covered by the FPC can be prevented from being affected by the electromagnetic interference from other electric devices on the circuit board 303, because a surface of the FPC is coated with shielding material.

FIG. 3C is a block diagram of the headphone socket assembly 300 connected to the circuit board 303 through the connector 304 (FIG. 3B), according to an exemplary embodiment. Referring to FIG. 3C, the first part 304*a* of the connector 304 may be welded on the FPC, and the second part 304*b* of the connector 304 may be welded on the circuit board 303. After the first part 304*a* and the second part 304*b* of the connector 304 are connected, the headphone socket 301 is electrically connected to the circuit board 303 through the connector 304.

In one exemplary embodiment, the connector 304 includes 10 pins for each of the first part 304*a* and the second part 304*b*. In other embodiments, the connector 304 may include less or more pins, and the connector 304 only needs to include pins corresponding to respective pins of the headphone socket 301. The number of pins of the connector 304 is not limited by the present disclosure.

Figure 4:
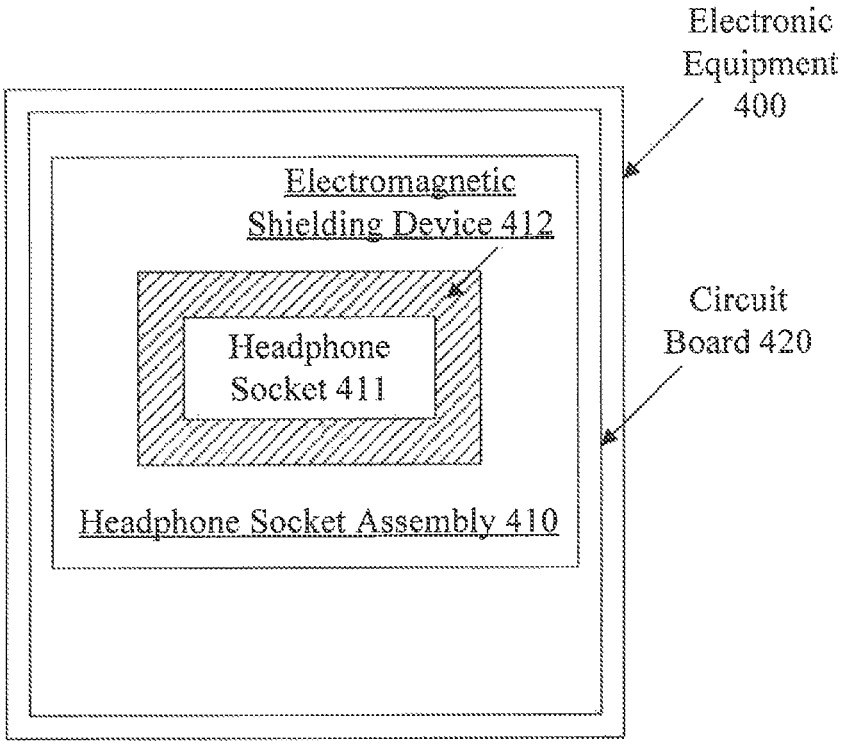
FIG. 4 is a block diagram of electronic equipment, according to an exemplary embodiment.

FIG. 4 is a block diagram of electronic equipment 400, according to an exemplary embodiment. Referring to FIG. 4, the electronic equipment 400 includes a headphone socket assembly 410 and a circuit board 420.

In exemplary embodiments, the headphone socket assembly 410 includes a headphone socket 411 and an electromagnetic shielding device 412. The headphone socket 411 is electrically connected to the circuit board 420 in the electronic equipment 400. The electromagnetic shielding device 412 is disposed at a periphery of the headphone socket 411. For example, the headphone socket assembly 410 may be any of the above-described headphone socket assemblies.

In exemplary embodiments, one or more pins of the headphone socket 411 in the headphone socket assembly 410 may be electrically connected to one or more conductive tracks on the circuit board 420 through one or more welding points, respectively, or through a connector, which will be described below.

Figure 5:
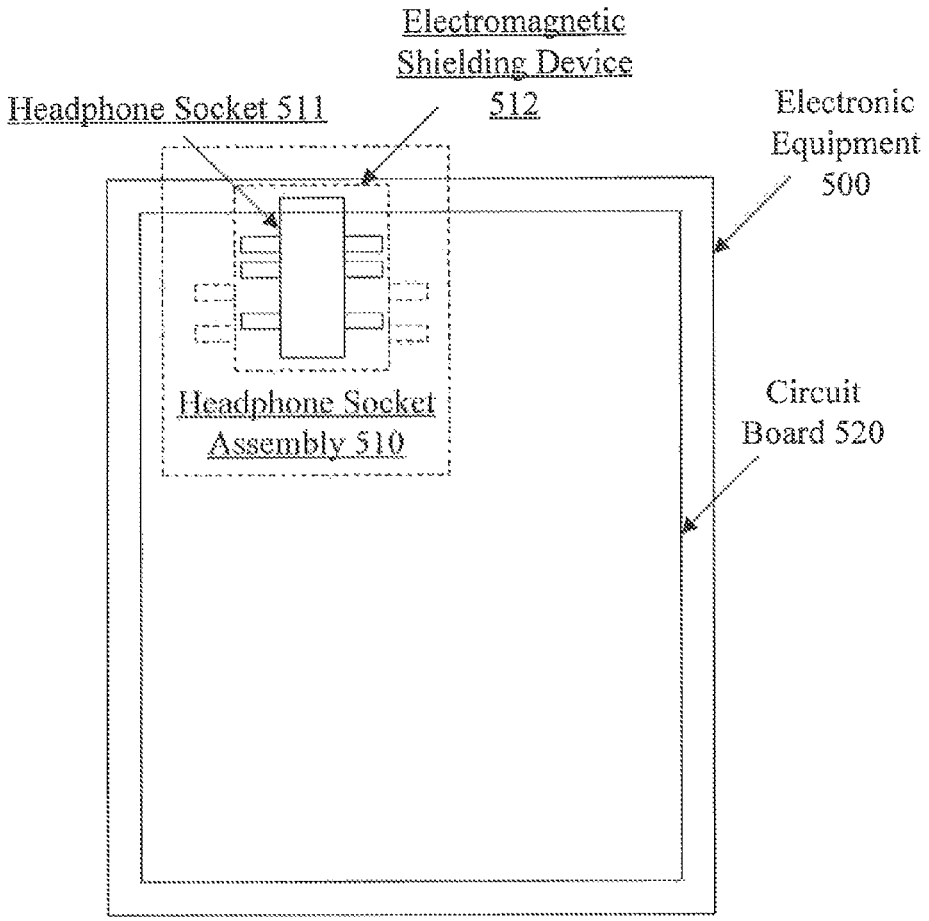
FIG. 5 is a block diagram of electronic equipment, according to an exemplary embodiment.

FIG. 5 is a block diagram of electronic equipment 500, according to an exemplary embodiment. Referring to FIG. 5, the electronic equipment 500 includes a headphone socket assembly 510, which may be the headphone socket assembly 200 (FIG. 2A), and a circuit board 520. The headphone socket assembly 510 further includes a headphone socket 511 and an electromagnetic shielding device 512.

In exemplary embodiments, the headphone socket 511 is electrically connected to the circuit board 520 in the electronic equipment 500. The electromagnetic shielding device 512 is disposed at a periphery of the headphone socket 511.

In exemplary embodiments, one or more pins of the headphone socket 511 are electrically connected to one or more conductive tracks on the circuit board 520 through one or more welding points corresponding to the one or more pins, respectively. The electromagnetic shielding device 512 may be, e.g., an electromagnetic shielding cover which covers the headphone socket 511 and the one or more welding points on the circuit board. The electromagnetic shielding cover can be grounded through the circuit board 520.

In exemplary embodiments, the headphone socket 511 is disposed on any side of the circuit board 520. The circuit board 520 is provided with at least one antenna.

Figure 6:
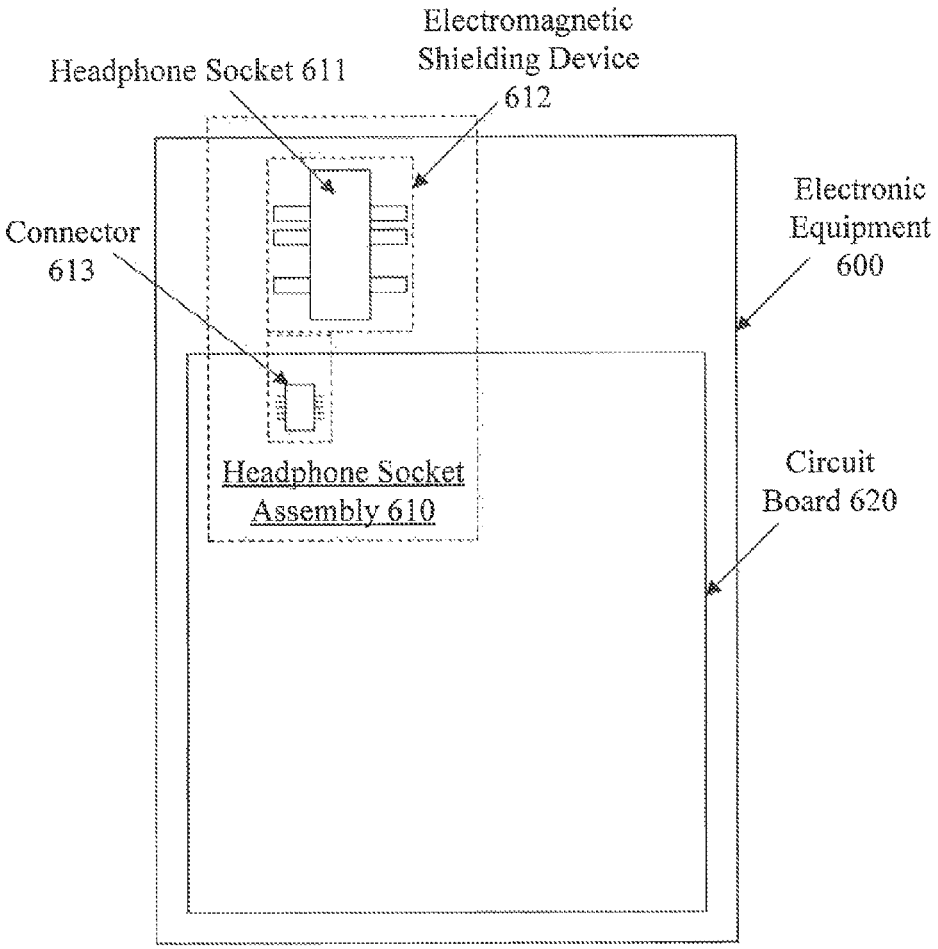
FIG. 6 is a block diagram of electronic equipment, according to an exemplary embodiment.

FIG. 6 is a block diagram of electronic equipment 600, according to an exemplary embodiment. Referring to FIG. 6, the electronic equipment 600 includes a headphone socket assembly 610, which may be the headphone socket assembly 300 (FIG. 3A), and a circuit board 620. The headphone socket assembly 610 further includes a headphone socket 611 and an electromagnetic shielding device 612.

In exemplary embodiments, the headphone socket 611 is electrically connected to the circuit board 620 in the electronic equipment 600. The electromagnetic shielding device 612 is disposed at a periphery of the headphone socket 611.

In exemplary embodiments, the headphone socket assembly 610 further includes a connector 613. One or more pins of the headphone socket 611 are electrically connected to one or more conductive tracks on the circuit board 620 via the connector 613. The electromagnetic shielding device 612 may be, e.g., an electromagnetic shielding layer which covers the periphery of the headphone socket 611. For example, the electromagnetic shielding layer is a flexible printed circuit board (FPC) coated with electromagnetic shielding material.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A headphone socket assembly for use in electronic equipment, comprising:

a headphone socket electrically connected to a circuit board in the electronic equipment; and an electromagnetic shielding device disposed at a periphery of the headphone socket, the electromagnetic shielding device being in contact with the headphone socket and providing no holding rib for holding the headphone socket;

wherein one or more pins of the headphone socket are electrically connected to one or more conductive tracks on the circuit board via one or more welding points corresponding to the one or more pins, respectively; and the electromagnetic shielding device includes an electromagnetic shielding cover which covers the headphone socket and the one or more welding points on the circuit board, and the electromagnetic shielding cover is grounded through the circuit board.

2. A headphone socket assembly for use in electronic equipment, comprising:

a headphone socket electrically connected to a circuit board in the electronic equipment;

an electromagnetic shielding device disposed at a periphery of the headphone socket, the electromagnetic shielding device being in contact with the headphone socket and providing no holding rib for holding the headphone socket; and a connector;

wherein one or more pins of the headphone socket are electrically connected to one or more conductive tracks on the circuit board, respectively, via the connector; and the electromagnetic shielding device includes an electromagnetic shielding layer which covers the periphery of the headphone socket.

3. The headphone socket assembly according to claim 1, wherein the headphone socket is disposed on any side of the circuit board, and the circuit board is connected with at least one antenna.

4. The headphone socket assembly according to claim 2, wherein the electromagnetic shielding layer is a flexible printed circuit board (FPC) coated with electromagnetic shielding material.

5. Electronic equipment, comprising:

a headphone socket assembly; and a circuit board;

wherein the headphone socket assembly includes:

a headphone socket electrically connected to the circuit board in the electronic equipment; and an electromagnetic shielding device disposed at a periphery of the headphone socket, the electromagnetic shielding device being in contact with the headphone socket and providing no holding rib for holding the headphone socket;

wherein one or more pins of the headphone socket are electrically connected to one or more conductive tracks on the circuit board via one or more welding points corresponding to the one or more pins, respectively; and the electromagnetic shielding device includes an electromagnetic shielding cover which covers the headphone socket and the one or more welding points on the circuit board, and the electromagnetic shielding cover is grounded through the circuit board.

6. Electronic equipment, comprising:

a headphone socket assembly; and a circuit board;

wherein the headphone socket assembly includes:

a headphone socket electrically connected to the circuit board in the electronic equipment;

an electromagnetic shielding device disposed at a periphery of the headphone socket, the electromagnetic shielding device being in contact with the headphone socket and providing no holding rib for holding the headphone socket; and a connector;

wherein one or more pins of the headphone socket are electrically connected to one or more conductive tracks on the circuit board, respectively, via the connector; and the electromagnetic shielding device includes an electromagnetic shielding layer which covers the periphery of the headphone socket.

7. The electronic equipment according to claim 5, wherein the headphone socket is disposed on any side of the circuit board, and the circuit board is connected with at least one antenna.

8. The electronic equipment according to claim 6, wherein the electromagnetic shielding layer is a flexible printed circuit board (FPC) coated with electromagnetic shielding material.

* * * * *